US007694350B2

(12) United States Patent
Hodges et al.

(10) Patent No.: US 7,694,350 B2
(45) Date of Patent: Apr. 13, 2010

(54) PRIVACY NURSING GOWN

(76) Inventors: Suzanne G. Hodges, 4600 Terry Lake Rd., Fort Collins, CO (US) 80524; Carolyn G. McKinley, 510 Whitley Dr., Gahanna, OH (US) 43230

( * ) Notice: Subject to any disclaimer, the term of this patent is extended or adjusted under 35 U.S.C. 154(b) by 43 days.

(21) Appl. No.: 11/579,761

(22) PCT Filed: May 9, 2005

(86) PCT No.: PCT/US2005/016345

§ 371 (c)(1),
(2), (4) Date: Nov. 7, 2006

(87) PCT Pub. No.: WO2005/110131

PCT Pub. Date: Nov. 24, 2005

(65) Prior Publication Data

US 2007/0240248 A1 Oct. 18, 2007

Related U.S. Application Data

(60) Provisional application No. 60/569,196, filed on May 7, 2004.

(51) Int. Cl.
*A41D 13/00* (2006.01)

(52) U.S. Cl. ..... 2/114; 2/69

(58) Field of Classification Search ..... 2/69, 2/104–106, 80, 83, 94–96, 85, 113–115
See application file for complete search history.

(56) References Cited

U.S. PATENT DOCUMENTS 1,098,155 A 5/1914 Knapp
1,489,046 A 4/1924 Thompson
3,116,491 A 1/1964 Previdi et al.
4,004,294 A 1/1977 Pinch (Continued)

FOREIGN PATENT DOCUMENTS

GB 2170095 * 7/1986 ..... 2/104

(Continued)

OTHER PUBLICATIONS

U.S. Appl. No. 60/569,196, filed May 7, 2004, Maternity Nursing Gown.

(Continued)

*Primary Examiner*—Gloria Hale
(74) *Attorney, Agent, or Firm*—Santangelo Law Offices, P.C.

(57) ABSTRACT

The present invention provides a garment (2) having large openings or perhaps even breast slits (14) in the garment that allow easy access to the full breast for instruction and access for nursing a newborn among other uses. Movable panels (12) may be provided on a front side (10) of a gown which can cover the openings while to nursing and can even provide privacy for the mother during nursing of their infant (1). The present invention may include a holder element (25) such as a skirt tuck element to allow the bottom of the gown to be pulled up and secured at a waistline area. Various closing elements may be located on the gown, such as but not limited to a sleeve closure element (18), a back closure element (22), and perhaps even a front closure element (16) to secure moveable panels.

34 Claims, 7 Drawing Sheets

U.S. PATENT DOCUMENTS

| | | | | |
|---|---|---|---|---|
| 4,458,365 | A | 7/1984 | Wood | |
| 4,570,268 | A | 2/1986 | Freeman | |
| 4,663,782 | A | 5/1987 | Knox et al. | |
| 4,920,578 | A | 5/1990 | Janzen et al. | |
| 4,969,215 | A | 11/1990 | Burkett | |
| 4,995,115 | A | 2/1991 | Ellis | |
| 4,995,116 | A | 2/1991 | Beauchamp et al. | |
| 5,097,535 | A | 3/1992 | Dye et al. | |
| 5,097,536 | A | 3/1992 | Cohen | |
| 5,133,086 | A * | 7/1992 | Truitt et al. | 2/114 |
| 5,182,813 | A | 2/1993 | Booze | |
| 5,440,763 | A * | 8/1995 | Shah et al. | 2/114 |
| 5,564,126 | A | 10/1996 | Chou | |
| 5,611,086 | A | 3/1997 | Eggen | |
| 5,799,330 | A | 9/1998 | O'Donoghue-Kitt | |
| 5,878,437 | A * | 3/1999 | Pater | 2/69 |
| D414,015 | S | 9/1999 | Small | |
| 6,237,153 | B1 | 5/2001 | Bowens | |
| 6,301,713 | B1 | 10/2001 | Aceves et al. | |
| 6,855,029 | B2 | 4/2002 | Rothman | |
| 6,854,132 | B1 | 2/2005 | Polzin | |
| 6,272,685 | B1 | 8/2007 | Kumar | |
| 2004/0166766 | A1 | 8/2004 | Schneider et al. | |
| 2004/0177429 | A1 | 9/2004 | Sanders | |
| 2004/0226072 | A1 | 11/2004 | Holmes-Otto | |
| 2005/0016345 | A1 | 5/2005 | Hodges et al. | |

FOREIGN PATENT DOCUMENTS

| | | |
|---|---|---|
| WO | WO2005110131 | 11/2005 |

OTHER PUBLICATIONS

International Application No. PCT/US2005/016345; International Search Report mailed Aug. 8, 2007.
International Application No. PCT/US2005/016345; Written Opinion of the International Searching Authority mailed Aug. 8, 2007.
International Application No. PCT/US2005/016345; International Preliminary Report on Patentability mailed Sep. 11, 2007.

* cited by examiner

PRIVACY NURSING GOWN

This application is a U.S. National Stage of International Application No. PCT/2005/016345, filed May 9, 2005, which claims the benefit of U.S. Provisional Application No. 60/569,196, filed May 7, 2004, each hereby incorporated by reference herein.

FIELD OF THE INVENTION

Generally, the present invention relates to apparel systems which can allow new mothers to nurse a newborn infant. Specifically, the present invention in embodiments focuses upon clothing systems for the hospital industry for new mothers to nurse their newborn babies.

BACKGROUND

Hospital gowns as well as other garments that can be used for nursing have been known for many years. Hospital gowns are typically a one piece material that opens in the back and can allow access to a patient for any of various medical procedures, observation and the like. They also are easy to put on and are meant to be comfortable for the patient.

Perhaps one of the most significant problems that those in some fields have faced is that a mother may desire privacy during nursing otherwise known as breast feeding. Some designs such as that disclosed in U.S. Pat. No. 5,182,813 to Booze may incorporate cover panels on an interior of a garment to cover a breast when not nursing. A pleat may be provided, however, such solutions may not have been adequate.

As shown in U.S. Pat. No. 4,458,365 to Wood, it has been known to utilize flaps that can be secured with ties and eyelets in a raised position. One of the problems with such a technique, however, may be that it may take extra time to have to fasten the flaps to the secured position, which may be frustrating. Securing a flap in a raised position also does not allow for privacy during nursing. The Wood reference also includes elastic in the gown which may be uncomfortable for the user.

Another problem may be that there is a need for adequate access to a breast for the instruction and learning process as well as for nursing a baby. Efforts in this regard may include those disclosed in U.S. Pat. No. 5,611,086 to Eggen including a design having circular openings for the breasts to protrude through. The circular openings may not adequately expose the breast for instruction and initial nursing of a baby.

U.S. Pat. No. 5,133,086 to Truitt provides for a hospital gown with an openable seam. In similar fashion, U.S. Pat. No. 6,237,153 to Bowens includes a hospital gown having three adjacent panels for access to a patient. Not only do such systems take time to open and close the seam, but they may also expose other parts of the body, when only the breast area may be needed.

Another problem associated with efforts in the past may be that the gowns are mostly open in the back. This may expose a patient's back side and may cause a need for a robe or the like to cover up a patient's back side.

DISCLOSURE OF THE INVENTION

The present invention includes a variety of aspects which may be selected in different combinations based upon the particular application or needs to be addressed. In one basic form, the invention discloses in embodiments a garment having large openings to accommodate full access to a breast of a postpartum mother for instruction of breast feeding and actual nursing of a baby. In other embodiments, a garment having openings may accommodate access to a breast for a female who may be receiving instruction for breast feeding an infant, a female who may have their breasts examined by a doctor, who may have tests being performed on their breasts, such as a mammogram, ultrasound, and the like. Another aspect of the invention may include in embodiments a panel that can cover an opening as well as a breast. This may help to provide privacy for a woman such as but not limited to while a mother may not be breast feeding as well as cover a baby and mother's breast during nursing. The invention may provide features to a garment, such as a gown, dress, shirt or the like that can provide access to other parts of the body through openable seams to the shoulders, back of the gown, and perhaps even a front of the gown and the like. Other embodiments may include a tuck aspect in which a lower portion of a gown can be tucked in place while a user may perform feminine hygiene and the like.

One object of the invention in embodiments may be to provide privacy to a nursing mother in a public setting such as a hospital. It may be desirable to provide a garment to be used with a postpartum mother perhaps during the first month after birth.

It is another object of the present invention in embodiments, to include panels that may loosely cover a woman's breast and opening for privacy while allowing quick, easy access to a breast. It may be desirable to provide a garment that is comfortable for the woman as well.

Another object of the invention in embodiments may be to provide large openings in a gown that may allow for full access to a breast. This may be desirable in the instruction on how to nurse an infant as well as with the nursing process.

It is another object of the invention in embodiments may be to provide a gown that can be closed in the back.

Yet another object of the invention in embodiments may be to provide a gown which allows access to other parts of the body such as an arm for receiving intravenous fluid and the like. One such goal may be to provide a shoulder opening, a sleeve opening, or the like.

Another object of the invention in embodiments may be to provide a garment holder feature, a tuck feature, or the like to hold a bottom of the gown up while performing feminine hygiene and the like.

Naturally, further objects, goals and embodiments of the inventions are disclosed throughout other areas of the specification, drawings and claims.

MODE(S) FOR CARRYING OUT THE INVENTION

Figure 1:
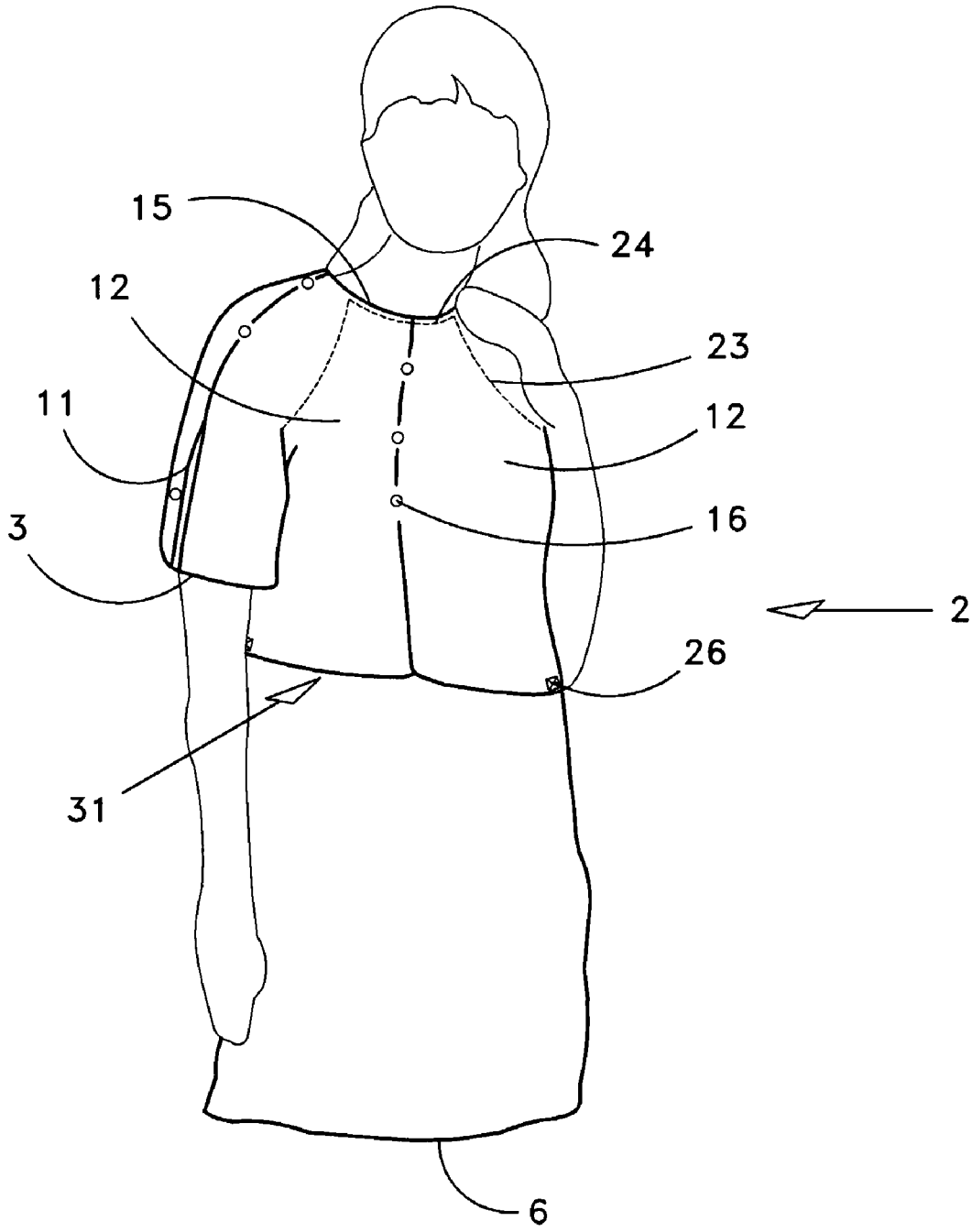
FIG. 1 is a front view of a garment having closed panels in accordance with the embodiments of the present invention.

The present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. This description should further be understood to support and encompass descriptions and claims of all the various embodiments, systems, techniques, methods, devices, and applications with any number of the disclosed elements, with each element alone, and also with any and all various permutations and combinations of all elements in this or any subsequent application.

The present invention may provide in embodiments, establishing a garment (2) with a front side (10), a back side (20), a neckline (15), and perhaps even two arm openings (3). Two breast slits may be established in a front side of a garment. Establishing may include, in embodiments, generating, creating, and perhaps even providing. A front side (10) of a gown may have two panels, perhaps even two movable panels (12). A movable panel may be located over a breast slit, perhaps even over each of two breast slits. A panel may be a distinct portion, section, or the like of a garment that may even be capable of being moved, such as between at least two positions. A movable panel (12) may include, in embodiments, a rectangular shaped piece of material attached at least one side. A movable panel may be a broad strip of material set vertically in or perhaps even on a garment. In other embodiments, a movable panel may be a flap in which it may be attached at least at one side.

Figure 3:
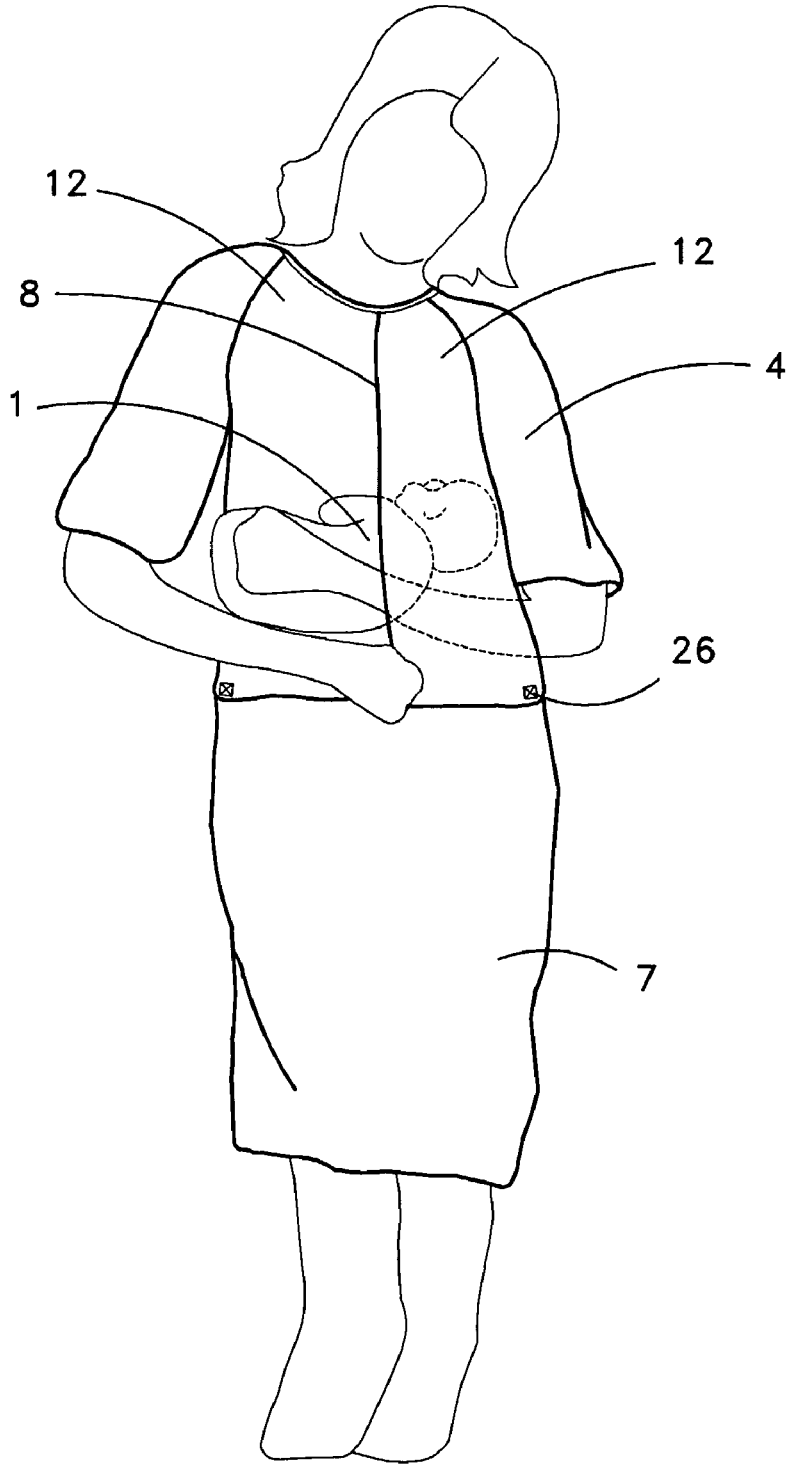
FIG. 3 is a front view of a garment when a mother may be nursing an infant while covering at least part of an infant with a movable panel in accordance with the embodiments of the present invention.
Figure 7:
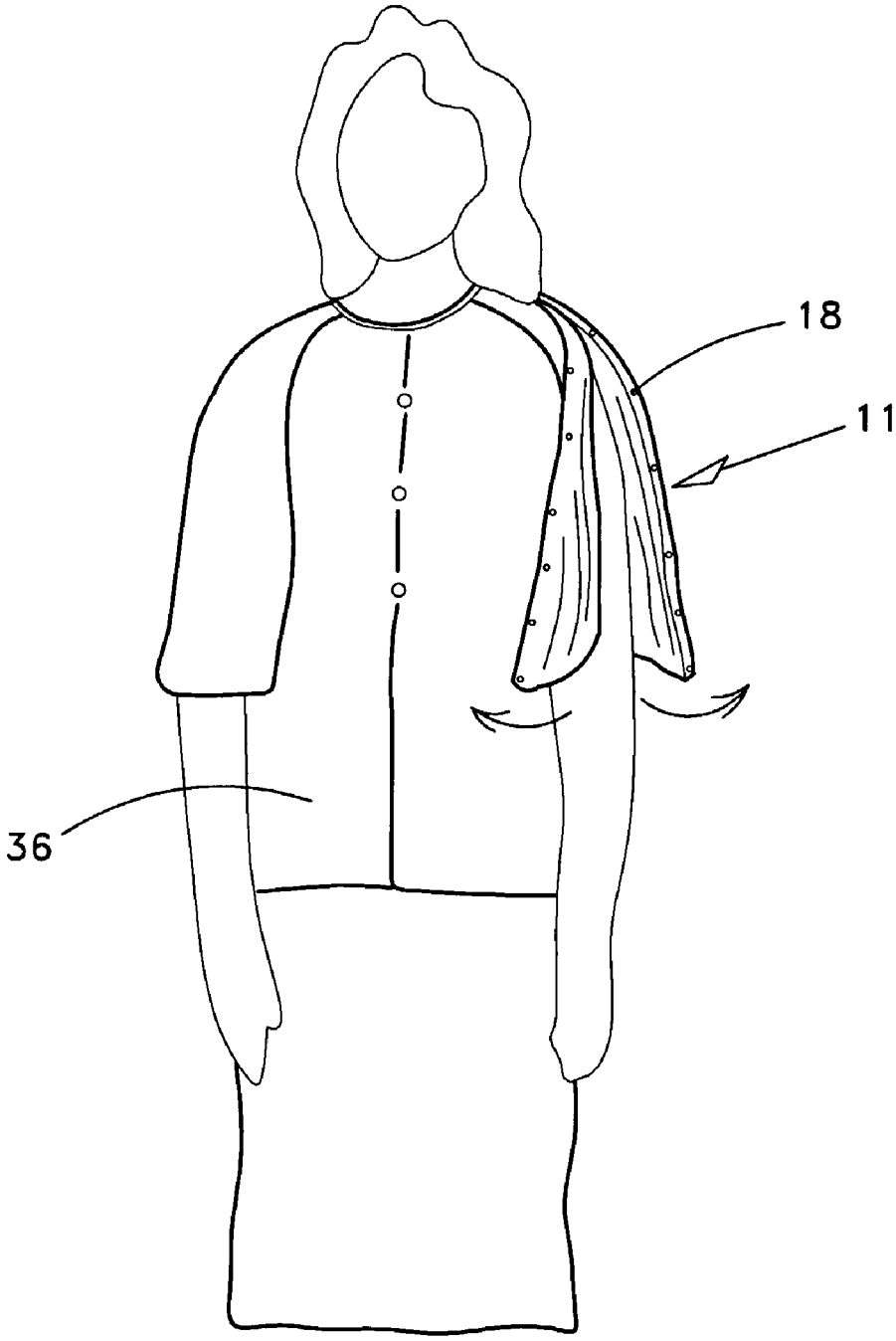
FIG. 7 is a front view of a garment having an openable sleeve and sleeve closure element in accordance with the embodiments of the present invention.

It may be desirable to provide privacy flaps which can be configured to cover at least part of an infant, for example an infant's head, and a mother's breast during breast feeding with at least one movable panel. As seen in FIG. 3, a panel may be moved to a covered position such as a closed panel placement position so as to cover a breast and an infant (1). This may provide privacy while a mother may be in an acute hospital setting. Further, when a mother may not be nursing, the panel(s) may be located or perhaps even placed over a breast slit in a closed panel placement position (36) as can be seen in FIG. 7.

Two movable panels may close, in embodiments, with a front closure element (16) such as but not limited to hook and loop fasteners, for example VELCRO®; fasteners; snaps; buttons; ties; adhesive substances; and the like closure elements. A front closure element may secure at least part of two movable panels together. A front closure element (16) may be located on a movable panel or perhaps even on each of two movable panels.

In embodiments, a movable panel may include a center edge (8) as can be understood from FIG. 3. When movable panels may be located over an opening, such as a breast slit, at least a center edge (8) of each of the movable panels may overlap. In embodiments, a front closure element may be located on a center edge of each of the moveable panels so as to secure each of the movable panels to each other.

Figure 5:
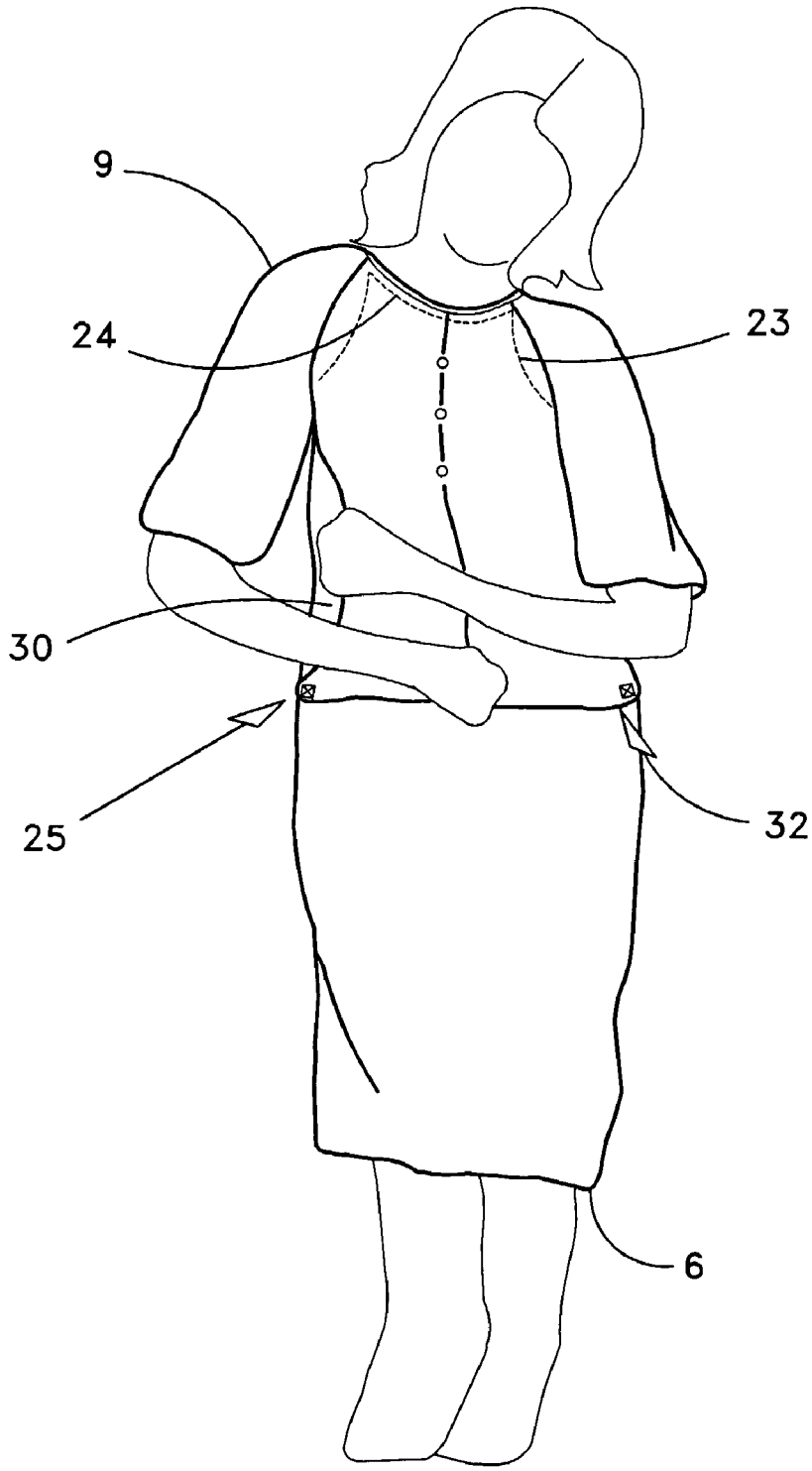
FIG. 5 is a front view of a garment showing a holder element having an open pocket in accordance with the embodiments of the present invention.

The present invention may provide, in embodiments, attaching two moveable panels (12) to at least part of a garment, perhaps even a front side (10) of a garment. In embodiments, the present invention may provide attaching a movable panel to a front side of a garment at a sleeve attachment position (23) and perhaps even at a neckline attachment position (24) as can be seen in FIGS. 1 and 5. In other embodiments, a movable panel may be attached to a front side of a garment at a waistline attachment position (26). A waistline attachment position (26) may include an attachment of a corner, perhaps even a bottom corner (32) of a moveable panel to a front side of a garment near a waistline area (31) as can be understood in FIG. 1. Of course, a movable panel may be attached in other areas of a garment and perhaps even at one, two or more attachment positions and it should be understood that other possibilities are to be included in this disclosure.

A movable panel, in embodiments, may cover an entire front chest area of a garment. This may include a full front garment coverage from a neckline (15) to a waistline area (31) when a moveable panel may be in a closed panel placement position. Embodiments may include fully covering a front side of a garment which may even provide substantially covering a breast slit with a movable panel in a closed panel placement position.

At least one movable panel may be moved to an open panel placement position (35) to uncover an opening and to expose a user's breast. An open panel placement position may include any position of a movable panel that may expose an opening in a front side of a garment. This may allow easier access to a breast and can keep a garment material out of the way. At least one moveable panel may be moved between an open panel placement position (35) and a closed panel placement position (36). When either or both of a movable panel may be in an uncovered, open panel placement position, the panel may be placed over a shoulder area (9) of a garment as can be understood in FIG. 2. A movable panel may be configured to allow it to be placed securely in an open panel placement position. By securely placing a movable panel over a shoulder area of a garment, a movable panel may remain over a shoulder area until a user moves a panel to another position. Unlike in past attempts, here there may not be a need to provide an additional securing feature to a panel, such as a tie or the like, to keep the panel in an uncovered position, open panel placement position. However, in embodiments, other securing features may be included in the present invention, such as ties, buttons, fasteners, snaps, and the like. When a user may place a movable panel over a shoulder area of a garment, the present invention may provide, in embodiments, one-step moving a movable panel to an open panel placement position. This may include manually pulling a movable panel over a shoulder area and placing it there.

It may be desirable to provide, in embodiments, balancing attachment of a movable panel to a garment with freedom of movement of a movable panel to an open panel placement position. It may be desirable to selectively attach a movable panel to a garment so as to allow, for example, a movable panel to be placed over a shoulder area without causing the rest of a garment to be moved or perhaps even pulled up.

Figure 2:
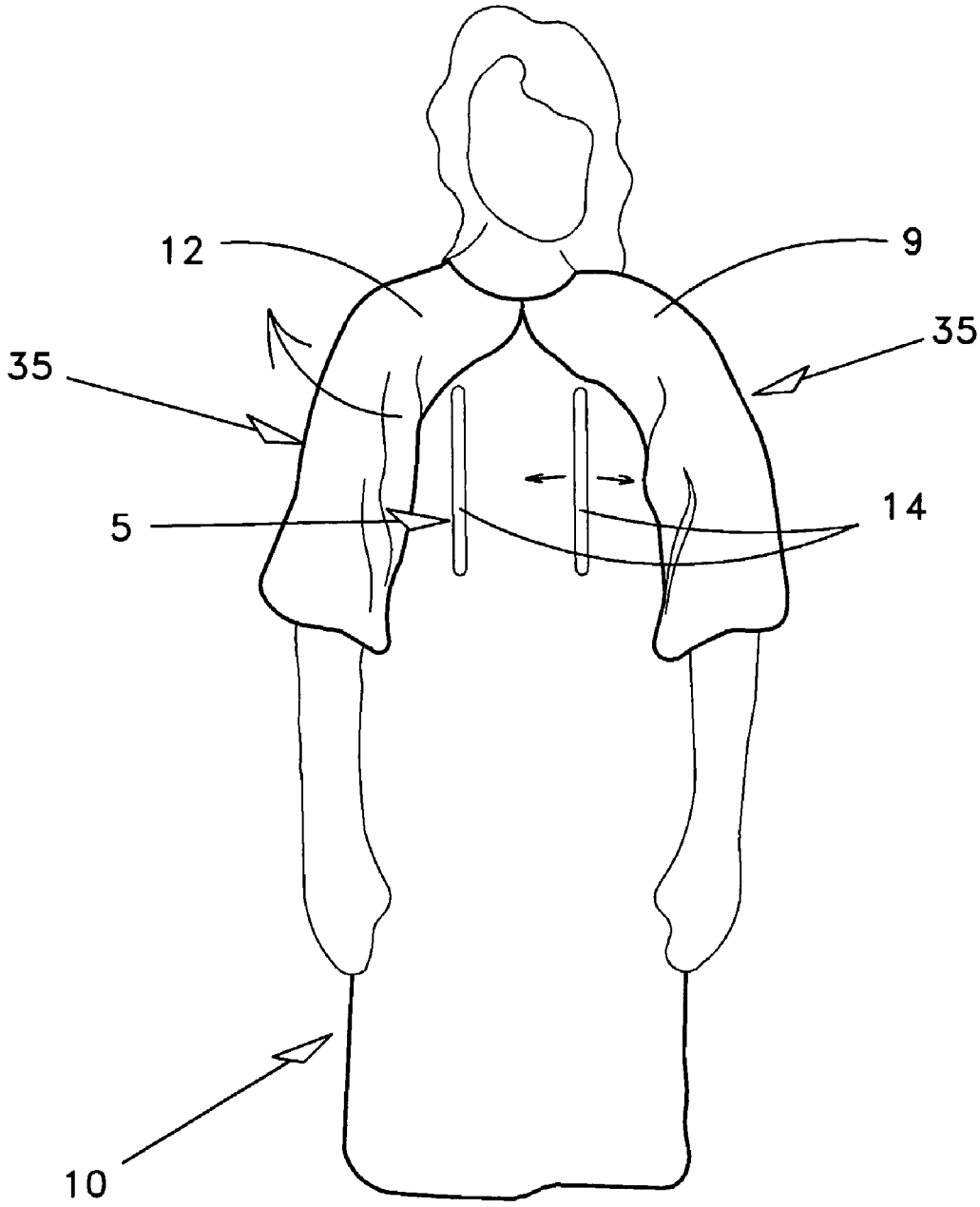
FIG. 2 is a front view of a garment in which movable panels are placed over a shoulder area and exposing two breast slits in accordance with the embodiments of the present invention.

As discussed and as shown in FIG. 2, an open panel placement position (35) may be desirable during instruction on how to breast feed, at an initial meeting between a baby and the breast, as well as with other situations herein discussed and the like. In embodiments, the present invention may provide an expansion of an opening or even an expansion element in which when a movable panel may be placed over a shoulder, the opening may spread or stretch apart.

A front of a gown may have two openings, for example a breast slit (14) that may expose the breasts of a woman. A breast slit may be located in a chest area (5) of a garment as can be understood from FIG. 2. A breast slit may be, in embodiments, a straight, narrow cut, opening, or the like. In other embodiments, a breast slit may be a shaped opening perhaps a non-linear shaped opening, a diamond shaped opening or the like. In embodiments, a slit may not be a pleat. Of course, other shapes and sizes of an opening in a front side of a garment may be possible.

Openings in the front side (10) of a gown may be large. A breast slit may be, in embodiments, a large slit. It may be desirable to provide a long slit opening that can allow an entire breast to be exposed as well as allow access to a breast. Large slits may allow full breast exposure. Large slits may be desirable so that during instruction of the lactation process the entire breast may need to be exposed for latching technique assistance. In embodiments, a large slit may have a length which may include, but is certainly not limited to:

about 11 inches;
between about 7 to about 13 inches;
greater than about 5 inches;
greater than about 7 inches;
greater than about 10 inches; and
greater than about 11 inches.

Of course, an opening may be any size or shape and all are meant to be included in this disclosure. A slit may be vertical as seen in FIG. 2, however other embodiments may include a slit that may be linear, shaped, diamond shaped, horizontal, diagonal, or any other orientation and a slit may even be in a "x" shape, or any other shape to which an opening can expose a breast and the like.

A large slit may be capable of spreading apart to a width as can be understood in FIG. 2. A width may include, but is certainly not limited to:

greater than about 5 inches;
greater than about 7 inches;
about 9 inches; and the like.

Of course, other widths are possible and all are meant to be included in this disclosure.

The present invention may provide in embodiments, establishing substantially linear long openings in a front side of a garment. Breast slits may have substantially linear long openings in a front side of a garment. In other embodiments, a substantially linear long opening may be slanted. Slanting may include, in embodiments, an opening in a direction other than vertical.

It may be desirable to provide, in embodiments, a holder element (25) in a garment so that at least part of a garment can be held in a position perhaps even temporarily held in a position. At least part of a bottom of a garment may be placed in a holder element. A holder element may include but is not limited to fasteners, hook and loop fasteners, snaps, loops, ties, adhesive substances, pocket, open pocket, hooks, buttons, and the like. For example, the present invention may provide in embodiments an opening in a garment perhaps even under a sleeve which may be capable of receipt and insertion of at least part of a bottom edge of a garment. A bottom edge of a garment may create a skirt (7) when a garment may be attached at a back side, such as in a hospital gown embodiment. A bottom edge of a garment may be a bottom of a shirt and the like, in other embodiments.

Another example of a holder element (25) may include a skirt tuck element to which a user may tuck at least part of a bottom edge (6) of a garment in a skirt tuck element. A skirt tuck element may be capable of accepting at least part of a bottom edge of a skirt. A skirt tuck element may be created at a waistline attachment position (26) as discussed hereafter. A user may pull at least part of a bottom edge of garment under or perhaps even over a skirt tuck element and perhaps hang a bottom edge over it.

Figure 6:
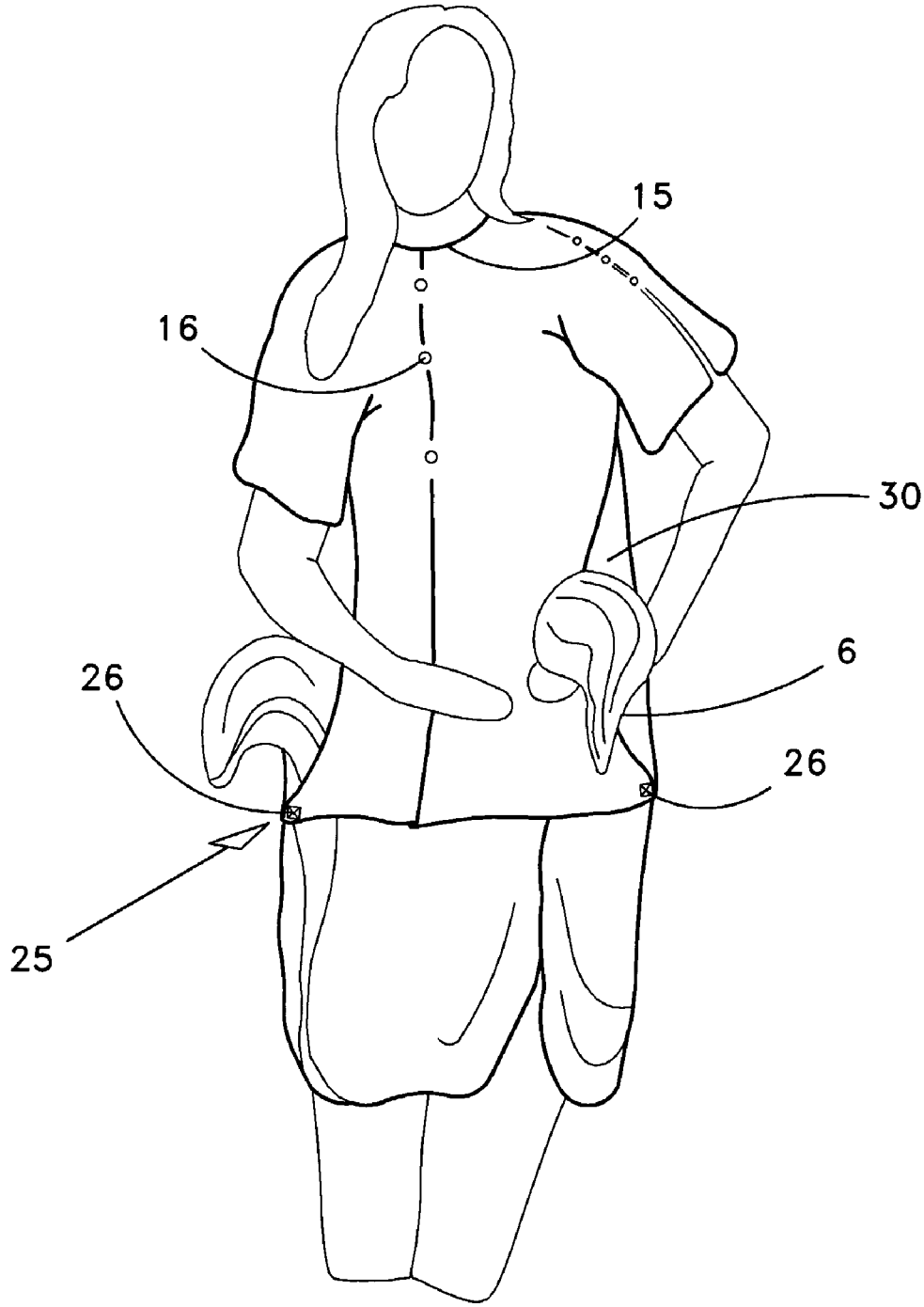
FIG. 6 is a front view of a garment in which part of a gown has been tucked into a skirt tuck element in accordance with the embodiments of the present invention.

In other embodiments, the present invention may provide tucking at least part of a bottom edge of a garment into a pocket and perhaps even an open pocket of a garment. A pocket may include receptacle; cavity; opening; a small bag-like attachment forming part of a garment and may be used to carry small articles; a flat pouch sewn inside; outside or perhaps even on a garment; a piece of material sewn inside, outside, or perhaps even on a garment; and the like. In embodiments, a pocket may be located vertically along an outside edge of panel. In other embodiments, a pocket may be an open pocket (30) as can be understood in FIGS. 5 and 6. A pocket may include additional material or a panel or the like and may be attached so as to provide a pocket in which an object can be placed and stored, such objects may be a pacifier, tissues, keys or any object. Of course, a pocket or even additional pockets may be added to the garment for storage.

At least part of a movable panel may be attached to at least part of a garment, as previously discussed. This may include a movable panel attached at the waist, forming an open pocket (30) at a waistline attachment position (26). At least part of a bottom edge of a garment may be tucked into an opening created by an attachment of at least part of a movable panel to a garment at a waistline area (31) of a garment. A corner of a panel perhaps even a lower outside corner of a panel may be attached to the front of a gown at a waistline attachment position (26) as can be seen in FIGS. 1, 3, 5 and 6. Upon performing feminine hygiene, perineal care and the like, in embodiments, a bottom edge (6) of a garment can be tucked into at least one open pocket (30) to provide a clear area in which to do feminine hygiene and the like. This way a garment may not be falling in the way. In embodiments, the present invention may accomplish this with a skirt tuck element. When a user wants to release the garment from a holder element, such as a pocket, skirt tuck element, open pocket or the like, a user may untuck and perhaps even pull the bottom edge out of a holder element and let the garment fall to an original position.

The present invention may provide in embodiments a sleeve (4), perhaps two sleeves attached to a garment. A sleeve may even be an openable sleeve (11) as shown in FIG. 7. At least part of an openable sleeve may be opened providing a partially openable sleeve, or perhaps in other embodiments, an openable sleeve may be a fully openable sleeve. There may be closure elements, such as snaps and the like along both shoulders and even sleeves which may be undone in the case that a patient may be receiving intravenous fluid or that she may need to provide skin to skin warmth for her new born baby or the like. An openable sleeve may be closed with a sleeve closure element (18). A sleeve closure element may include but is not limited to hook and loop fasteners, fasteners, snaps, buttons, ties, and the like. Of course, some embodiments of the present invention may exclude sleeves and provide arm openings near a shoulder area of a garment creating a type of sleeveless garment.

Figure 4:
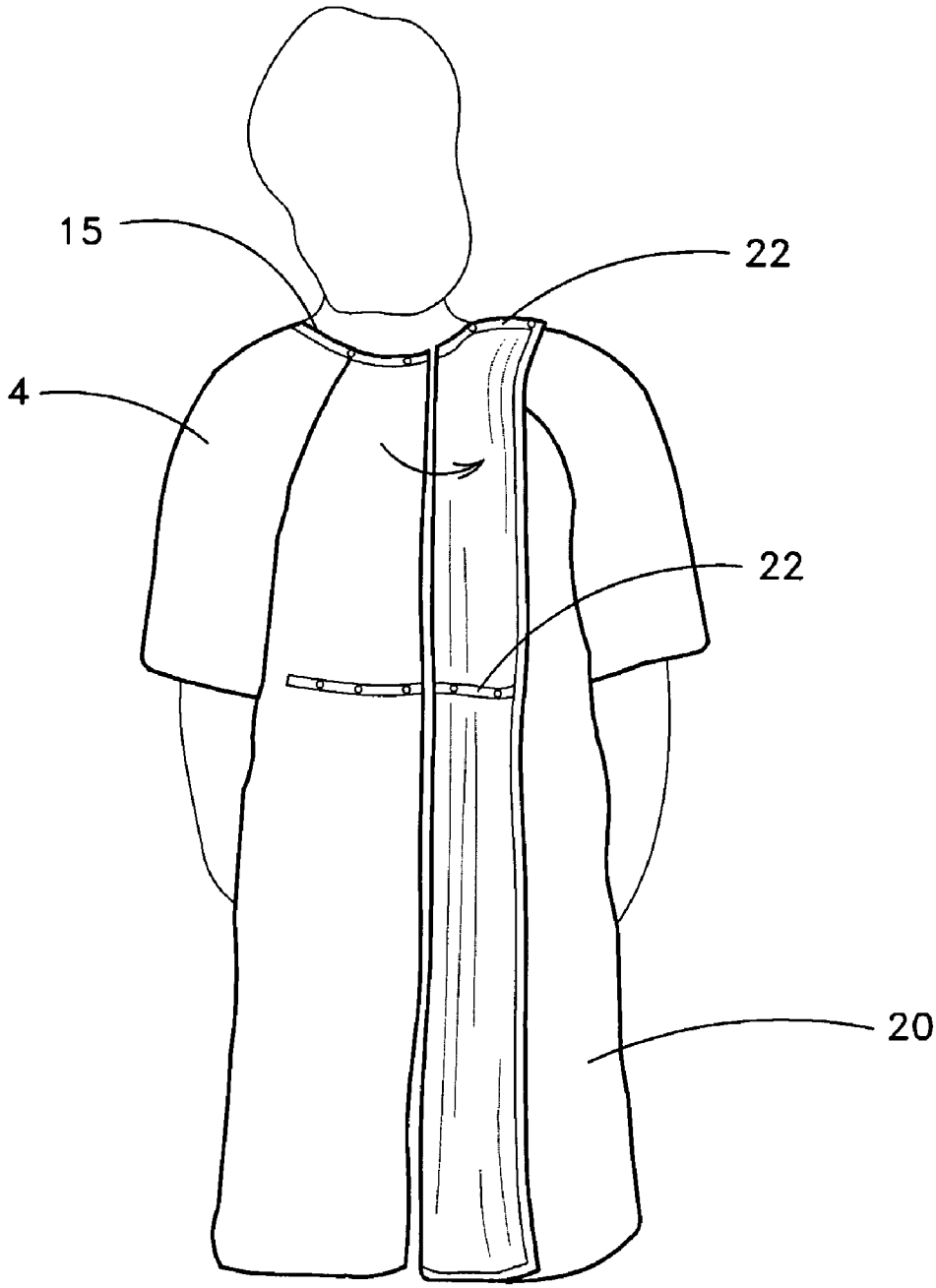
FIG. 4 is a back view of a garment showing a back side and back closure elements in accordance with the embodiments of the present invention.

A garment may be, in embodiments, attachable to itself at a back side (20). A garment may be robe, smock or the like in which a user can put their arms through an arm hole and wrap the garment over a front of a user's body. In embodiments, a garment may have an open back side such as shown in FIG. 4. An open back side may include at least one back closure element (22). Accordingly, the present invention may include, in embodiments, closing an open back side of a garment around a user with at least one back closure element. A back closure element may include, but is not limited to hook and loop fasteners, fasteners, snaps, buttons, ties, and the like.

In other embodiments, a back closure element may include at least one row of snaps and may even include two rows of snaps to which a garment can be attached. It may be desirable to provide an adjustment feature to a garment so that various sized individuals may fit into the same garment. A row of snaps may provide this flexibility along with other back closure elements. In embodiments, a back closure element (22) may include about four snaps, at the neck and even four snaps at the waist, perhaps even at about 1½ inches apart in a line across to accommodate different sized women. The number of closing elements and even the number of snaps and the like may be varied. A garment may close completely in the back to eliminate the need for a robe. A garment may be made large to accommodate large women, however small women can wear this gown with comfort.

In yet other embodiments, the invention may include a panel that may sweep over the entire front of a gown and can cover both openings. A panel may be attached to one side of a front side of a gown and can be thrown over a shoulder area on an opposite side of a gown. This panel may be large enough to be thrown over a shoulder and still cover the openings. A panel may be taken from the shoulder to expose openings. A panel may also provide privacy for a mother while nursing. In embodiments, a panel may be secured near an opposite shoulder via an attachment element such as snaps, buttons, fasteners, and the like.

In embodiments, the present invention may be made of a fabric which may include a material such as but not limited to cotton, polyester, wool, spandex, acetate, synthetic materials, natural materials, combinations of different materials, and the like. It may be desirable to have a fabric that is comfortable and durable as well as cost effective for manufacturing.

Of course, there may be many uses for the various embodiments of the present invention such as a garment that can be used as a hospital gown as well as that can be used at home and the like. A garment as described herein is not meant to be limited to the hospital setting. In alternative embodiments, the present invention may include a shirt, a house dress and the like.

As can be easily understood from the foregoing, the basic concepts of the present invention may be embodied in a variety of ways. It involves both nursing gown techniques as well as devices to accomplish the appropriate nursing gown. In this application, the nursing gown techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims herein or in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "closure" should be understood to encompass disclosure of the act of "closing"—whether explicitly discussed or not—and, conversely, were there effectively disclosure of the act of "closing", such a disclosure should be understood to encompass disclosure of a "closure" and even a "means for closing." Such changes and alternative terms are to be understood to be explicitly included in the description.

Any patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition are hereby incorporated by reference. Exhibit A which includes instructions for use of a pattern that can be used to make a gown as herein described is also incorporated by reference. Finally, all references listed in the list presented below or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

I. U.S. Patent Documents

| DOCUMENT NO. & KIND CODE (if known) | PUB'N DATE mm-dd-yyyy | PATENTEE OR APPLICANT NAME |
|---|---|---|
| 2004/0226072 A1 | 11/18/2004 | Holmes-Otto |
| 2004/0177429 A1 | 09/16/2004 | Sanders |
| 2004/0166766 A1 | 08/26/2004 | Schneider et al. |
| Des. 414,015 | 09/21/1999 | Small |
| 4,458,365 | 07/10/1984 | Wood |
| 4,920,578 | 05/01/1990 | Janzen et al. |
| 4,969,215 | 11/13/1990 | Burkett |
| 4,995,116 | 02/26/1991 | Beauchamp et al. |
| 5,133,086 | 07/28/1992 | Truitt et al. |
| 5,182,813 | 02/02/1993 | Booze |
| 5,440,763 | 08/15/1995 | Shah et al. |
| 5,611,086 | 03/18/1997 | Eggen |
| 6,031,713 B1 | 10/16/2001 | Aceves et al. |
| 6,237,153 B1 | 05/29/2001 | Bowens |
| 6,272,685 B1 | 08/14/2001 | Kumar |
| 6,854,132 B1 | 02/15/2005 | Polzin |
| 6,855,029 B2 | 04/18/2002 | Rothman |

Thus, the applicant(s) should be understood to have support to claim and make a statement of invention to at least: i) each of the maternity gown devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, and xii) each potentially dependent claim or concept as a dependency on each and every one of the independent claims or concepts presented.

With regard to claims whether now or later presented for examination, it should be understood that for practical reasons and so as to avoid great expansion of the examination burden, the applicant may at any time present only initial claims or perhaps only initial claims with only initial dependencies. Support should be understood to exist to the degree required under new matter laws—including but not limited to European Patent Convention Article 123(2) and United States Patent Law 35 U.S.C. §132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A method of using a maternity nursing gown comprising the steps of:

providing a maternity nursing gown garment with a front side, a back side, a neckline, a bottom edge, a pocket, and two arm openings;

providing two open breast slits in said front side of said garment and two moveable privacy panels separately attached to at least part of said front side of said garment;

placing said moveable privacy panels in a closed panel placement position over said open breast slits;

substantially covering said open breast slits with said two movable privacy panels in said closed panel placement position; and tucking at least part of said bottom edge of said garment into said pocket of said garment to shorten said garment.

2. A method of using a maternity nursing gown according to claim 1 wherein said garment comprises a hospital gown.

3. A method of using a maternity nursing gown according to claim 1 wherein said two open breast slits are located in a chest area of said garment.

4. A method of using a maternity nursing gown according to claim 1 wherein said two open breast slits comprises two substantially linear long openings in said front side of said garment.

5. A method of using a maternity nursing gown according to claim 4 wherein said two substantially linear long openings in said front side of said garment comprises two slanted substantially linear long openings in said front side of said garment.

6. A method of using a maternity nursing gown according to claim 1 wherein said step of providing said two open breast slits in said front side of said garment comprises the step of providing two large open slits in said front side of said garment.

7. A method of using a maternity nursing gown according to claim 6 and further comprising the step of exposing a user's full breast with said large open slit.

8. A method of using a maternity nursing gown according to claim 6 wherein said large open slits comprises a length selected from a group consisting of:

greater than about 5 inches;

greater than about 7 inches;

greater than about 10 inches; and greater than about 11 inches.

9. A method of using a maternity nursing gown according to claim 6 and further comprising the step of spreading apart said large open slits to a width.

10. A method of using a maternity nursing gown according to claim 9 wherein said width is selected from a group consisting of:

greater than about 5 inches; and greater than about 7 inches.

11. A method of using a maternity nursing gown according to claim 1 and further comprising the steps of moving at least one of said two movable privacy panels to an open panel placement position to expose at least one of said open breast slits; and moving at least one of said moveable privacy panels between said open panel placement position and said closed panel placement position.

12. A method of using a maternity nursing gown according to claim 1 and further comprising the steps of:

exposing a mother's breast through at least one of said open breast slits;

covering at least part of an infant and said mother's breast during breast feeding with at least one of said two movable privacy panels.

13. A method of using a maternity nursing gown according to claim 11 wherein said step of moving at least one of said two movable privacy panels to said open panel placement position comprises the step of placing at least one of said two movable privacy panels over a shoulder area of said garment.

14. A method of using a maternity nursing gown according to claim 13 wherein said step of placing at least one of said two movable privacy panels over said shoulder area comprises the step of securely placing at least one of said two movable privacy panels over said shoulder area of said garment.

15. A method of using a maternity nursing gown according to claim 11 wherein said step of moving said at least one of said two movable privacy panels to said open panel placement position comprises the step of manually pulling at least one of said two movable privacy panels over said shoulder area.

16. A method of using a maternity nursing gown according to claim 1 and further comprising the step of securing said at least one of said two movable privacy panels when in said closed panel placement position with a front closure.

17. A method of using a maternity nursing gown according to claim 16 wherein said front closure is selected from a group consisting of hook and loop fasteners, fasteners, snaps, buttons, and ties.

18. A method of using a maternity nursing gown according to claim 1 and further comprising the step of overlapping at least a center edge of each of said movable privacy panels when in said closed panel placement position.

19. A method of using a maternity nursing gown according to claim 18 and further comprising the step of providing a front closure located on said center edge of each of said two movable privacy panels.

20. A method of using a maternity nursing gown according to claim 19 wherein said front closure is selected from a group consisting of hook and loop fasteners, fasteners, snaps, buttons, and ties.

21. A method of using a maternity nursing gown according to claim 1 and further comprising the step of fully covering said open breast slits and said front side of said garment from said neckline to a waistline area with said two movable privacy panels.

22. A method of using a maternity nursing gown according to claim 1 and further comprising the step of holding at least part of a garment up with a holder selected from a group consisting of snaps, loops, pocket, open pocket, hooks, and buttons.

23. A method of using a maternity nursing gown according to claim 1 wherein said step of tucking said at least part of said bottom edge of said garment into said pocket comprises the step of tucking at least part of said bottom edge of said garment into an open pocket of said garment.

24. A method of using a maternity nursing gown according to claim 23 wherein said step of tucking at least part of said bottom edge of said garment into said open pocket comprises the step of tucking at least part of said bottom edge of said garment into an opening created by an attachment of at least part of said movable privacy panel to said garment.

25. A method of using a maternity nursing gown according to claim 23 wherein said step of tucking at least part of said bottom edge of said garment into said open pocket comprises the step of tucking at least part of said bottom edge of said garment into an opening created by an attachment of at least part of said movable privacy panel to said garment at a waistline area of said garment.

26. A method of using a maternity nursing gown according to claim 1 wherein said two movable privacy panels each comprise a rectangular shaped piece of material partially attached to said front of said garment.

27. A method of using a maternity nursing gown comprising the steps of:

providing a maternity nursing gown garment with a front side, a back side, a bottom edge, a pocket, and a neckline;

providing two open breast slits with substantially linear long openings in said front side of said garment, wherein said open breast slits are located in a chest area of said garment;

providing two moveable privacy panels separately attached to at least part of said front side of said garment;

placing said moveable privacy panels in a closed panel placement position over said open breast slits;

substantially covering said open breast slits with said two movable privacy panels in said closed panel placement position;

securing said moveable privacy panels when in said closed panel placement position with a front closure element;

moving at least one of said two movable privacy panels to an open panel placement position to expose at least one of said open breast slits;

moving at least one of said moveable panels between said open panel placement position and said closed panel placement position; and tucking at least part of said bottom edge of said garment into said pocket of said garment to shorten said garment.

28. A method of using a maternity nursing gown according to claim 27 and further comprising the step of overlapping at least a center edge of each of said two movable privacy panels when in said closed panel placement position.

29. A method of using a maternity nursing gown according to claim 27 wherein said step of tucking said at least part of said bottom edge of said garment into said pocket comprises the step of tucking at least part of said bottom edge of said garment into an open pocket of said garment.

30. A method of using a maternity nursing gown according to claim 29 wherein said step of tucking at least part of said bottom edge of said garment into said open pocket comprises the step of tucking at least part of said bottom edge of said garment into an opening created by an attachment of at least part of said movable privacy panel to said garment.

31. A method of using a maternity nursing gown according to claim 29 wherein said step of tucking at least part of said bottom edge of said garment into said open pocket comprises the step of tucking at least part of said bottom edge of said garment into an opening created by an attachment of at least part of said movable privacy panel to said garment at a waistline area of said garment.

32. A method of using a maternity nursing gown according to claim 27 wherein said two movable privacy panels each comprise a rectangular shaped piece of material partially attached to said front of said garment.

33. A method of using a maternity nursing gown according to claim 27 and further comprising the steps of:

exposing a mother's breast through at least one of said open breast slits; and covering at least part of an infant and said mother's breast during breast feeding with at least one of said two movable privacy panels.

34. A method of using a maternity nursing gown according to claim 27 and further comprising the step of overlapping at least a center edge of each of said two moveable privacy panels when in said closed panel placement position.

* * * * *